US006581257B2

(12) United States Patent
Burton et al.

(10) Patent No.: US 6,581,257 B2
(45) Date of Patent: Jun. 24, 2003

(54) PROCESS FOR MAKING A WARP BEAM OF UNTWISTED FIBERGLASS STRANDS

(75) Inventors: Kevin R. Burton, Butler, PA (US); Kenneth D. Beer, Vandergrift, PA (US); John J. Kuhn, Portersville, PA (US); Lewis J. Culp, Apollo, PA (US); Robert P. Buss, Schenley, PA (US)

(73) Assignee: Dielectric Solutions, LLC, East Butler, PA (US)

( * ) Notice: Subject to any disclaimer, the term of this patent is extended or adjusted under 35 U.S.C. 154(b) by 0 days.

(21) Appl. No.: 10/092,860

(22) Filed: Mar. 7, 2002

(65) Prior Publication Data

US 2002/0129474 A1 Sep. 19, 2002

Related U.S. Application Data

(60) Provisional application No. 60/276,011, filed on Mar. 15, 2001.

(51) Int. Cl.[7] ..... D02H 5/00

(52) U.S. Cl. ..... 28/190

(58) Field of Search ..... 28/190, 200, 172.1, 28/191, 192, 193, 194, 195, 196, 197, 202, 208, 290; 139/35, 97, 99, 100; 242/131.1, 128, 129.1, 130, 131, 550, 472.8, 472.1

(56) References Cited

U.S. PATENT DOCUMENTS

| | | | | | |
|---|---|---|---|---|---|
| 1,997,498 | A | * | 4/1935 | Rush | 28/190 |
| 2,092,811 | A | * | 9/1937 | Moncrieff et al. | 28/190 |
| 2,542,097 | A | * | 2/1951 | Shaffer et al. | 28/190 |
| 5,178,193 | A | * | 1/1993 | Sato et al. | 139/291 R |
| 5,295,287 | A | * | 3/1994 | Chateau | 28/187 |
| 5,531,392 | A | * | 7/1996 | Weiner | 28/190 |
| 5,588,194 | A | * | 12/1996 | Ulbrich et al. | 28/194 |
| 5,613,643 | A | * | 3/1997 | Weiner | 242/131 |
| 6,233,798 | B1 | * | 5/2001 | Bogucki-Land | 28/190 |

* cited by examiner

*Primary Examiner*—Amy B. Vanatta
(74) *Attorney, Agent, or Firm*—Paul Beck & Associates

(57) ABSTRACT

A package of fiberglass is unwound such that the revolution of the unwinding is controlled relative to linear payout speed of the package. A strand of fiber is pulled from the package while simultaneously rotating the package about a longitudinal axis of the package.

4 Claims, 4 Drawing Sheets

PROCESS FOR MAKING A WARP BEAM OF UNTWISTED FIBERGLASS STRANDS

CROSS REFERENCE TO RELATED APPLICATION

Applicants are claiming the benefit of a prior filed Provisional Application No. 60/276,011 field on Mar. 15, 2001.

BACKGROUND OF THE INVENTION

1. Field of the Invention

The invention is a process by which a package of fiber (yarn) may be unwound in a manner such that the revolution of the unwinding process may be controlled relative to linear payout speed of the package. This invention may be applied to a variety of processes, but has particular interest in a textile beaming operations where multiple packages are unwound and then re-spooled together on another holding vessel, frequently a flanged beam. The preferred embodiment is a textile warping or beaming operation where a low-twist yarn (less than 2.5 turns per inch) is being processed. Yarns processed can be any textile continuous filament, monofilament, or staple yarn, such as fiberglass, nylon, polyester, polyethylene, denim, cotton, or aramid yarns.

2. Description of the Related Art

The conventional warping and beaming processes in textile operations usually consists of loading a number of packages onto a creel, or package holder, and simultaneously pulling the yarn off the packages to be spooled together onto a beam. This method traditionally utilizes a static package holder such that the packages are loaded onto a pin, clamp, bucket, or platform. The yarn is then pulled off of the packages such that the yarn is either rotating around the outside of the package as it is paid out (in the case of outside draw packages) or rotates around the inner circumference of the package (in the case of inside draw packages).

In this conventional process, each revolution of the yarn as it is paid out imparts an additional revolution of the yarn bundle or twist. Expressed differently, each payout revolution imparts an additional turn of the yarn, either increasing or decreasing the number of turns per inch, depending on the direction of the yarn's inherent twist and the direction of the payout revolution. Interestingly, because the length of one payout revolution changes with the decreasing package size as the circumference changes, the amount of twist imparted or removed during this process changes through the run of the package.

With a processed yarn that has been through a twisting operation prior to beaming, there exists a high number of twists per inch in the yarn before it is paid out in warping or beaming, and this twist is applied in a manner such that the yarn is secured in this twist pattern. Therefore, a single additional twist or untwist in the yarn every linear length equivalent of the circumference of the package is negligible. However, in low- or zero-twist yarns; this impact of the payout revolutions can be significant. The payout twist has an additional problem of significance in this operation. Because the payout twist is low in frequency, the impact of the additional twisting is a function of a cumulative build of twist tension in the process. The twist will begin to back-up behind a contact point in the process where the yarn is not permitted to easily rotate. At this point, the payout twist (one twist for each payout revolution) begins to cumulatively add together behind this contact point until there is enough tension from the twist to overcome the static resistance of the contact point. In this manner, a large cumulative build of twist is released into the line at one time, and causes difficulties in the process with yarns that have not been previously twisted. The impact in the processing of the yarn consists primarily of individual yarns having a tendency to curl and coil around each other at the point that the payout twist propagates through the line.

With conventional methods, the impact is often disguised for two reasons: First, the yarn generally has already been twisted on a twist frame prior to the warping operation. This previous twisting step has the tendency to greatly reduce the cabling or coiling encountered during warping. Second, after warping, an additional process step called slashing applies a polyvinyl alcohol or starch-based coating on top of the yarn bundles. This aids in providing a layer of softer material that can shear during weaving operations, allowing the yarn ends that are crossed an opportunity to abrade the coating as it un-coils, rather than abrading the yarn itself. Although the invention covered in this application will make improvements in the standard, conventional methods, the current methods allow product to be produced. The nature of the impact has remained out of notice until the impact on very-low twist yarns was evidenced.

Most conventional operations utilize a twisted yarn supply, and thus this inherent problem for very low twist yarns has remained hidden, and has historically not impacted the warping or beaming operation. This is also the reason the problem and solution were not readily apparent even to those highly skilled in the art, and which makes the solution in this invention application novel. Indeed, several months of operations were pursued trying to simply discover the cause of the defects, and additional time spent on devising the solution.

BRIEF SUMMARY OF THE INVENTION

It is therefore the design of this process invention to provide a method to improve the warping and beaming processes of textile operations by means of an alternate payout method of the yarn fibers. Rather than fixing the package holder and allowing the yarn to revolve around the circumference of the package, thereby imparting an additional positive or negative twisting action, the packages will be rotated at the line speed of the operation. This will allow the yarn to be paid out in a manner such that the yarn bundle does not rotate and "flip over" itself and imparting a twist for each revolution.

The preferred embodiment of the yarn is a warping operation of glass fiber packages that have been produced such that the yarn is paid out from the inside of the package. Alternative fibers and payout methods will equally benefit from this process invention, as the basic physics of the action remain the same regardless of substrate of packaging means. As long as the package has previously been static in mounting, the process invention will improve the consistency and runability of the operation.

The process invention comprises: a method of mounting a package so that it may be driven and rotated according to the operational requirements; a drive system designed to perform the work of rotating the packages; a controller to adjust the rotational surface speed of the packages to the line speed of the operation; and a feedback system to correct differences between the rotation and line speeds.

Packages are mounted in a truck so that the yarn packages may be paid out from the inside of each package. The packages have a cylindrical-like shape, and are placed inside a series of fingers that grasp the outside of the package, so that the hollow end of the cylinder faces the draw direction of the warping process. These fingers are mounted on a back plate of rigid material that is attached to a drive shaft. The drive shaft is free to turn and is mounted with bearings to a rack or truck system for orienting the packages to the warper creel. On the rear of the drive shaft is a pulley or gear that is attached to the drive belt or chain. On a single truck of packages, the entire system of packages is ganged together onto a single main drive belt or gear, which is attached to the motor. A motor drive signals the motor to rotate at the appropriate speed to match the warper line speed. The motor drive is in communication with the main drive of the warper system for signaling start, stop, and speed changes. Further, a feedback system to gauge the accuracy of the drive signal can be installed, linked to the controller and line speed.

We provide a process for making a warp beam of untwisted fiberglass strands comprising: providing a fiberglass forming package with a single fiberglass strand wound on the package and having a longitudinal axis; supporting the package in a manner that permits rotation of the package about the longitudinal axis; rotating the package; pulling the single strand from the package while simultaneously rotating the package; and wrapping the single strand which is pulled from the package onto a beam which can be used to form a warp beam. We further provide using a plurality of fiberglass forming packages and wrapping the respective plurality of strands onto the beam.

We maintain a rotational surface speed of the package equal to a linear speed of pulling the single strand. The rotation of the forming package is done in a direction of rotation opposite to a direction of rotation in producing the forming package such that the fiberglass strand is pulled off the package with a net zero amount of twist.

We weave the strands from the beam with other strands of fiber glass having zero twist on a loom to form fiber glass cloth.

A warp beam made from untwisted fiberglass strands is also especially well suited for the manufacture of a tape. A tape which is reinforced with fiberglass strands, commonly known as filament tape or strapping tape, is available which uses alternating strands of right-hand and left-hand twist to avoid the tendency for the tape to curl and twist. A similar product made from untwisted fiberglass strands using the present invention would avoid the need and expense of alternating strands of right-hand and left-hand twist.

DETAILED DESCRIPTION OF THE INVENTION AND BEST MODE OF PRACTICING THE INVENTION

Definitions

Beam—a structural piece of equipment designed to hold yarns, consisting of a cylindrical barrel with two vertical disc flanges mounted on the barrel to yield a section of the barrel that is enclosed on either side by the flanges; similar in appearance to an oversized spool used in sewing operations.

Fiberglass cloth—a fabric that is constructed such that the individual strands that define the body of the fabric consist of fiberglass yarns.

Fiberglass forming package—a package of yarn that is produced in the manufacture of continuous filament fiberglass strands; the fiberglass strand is a wrapped in a continuous length around a cylindrical tube.

Linear speed of pulling the single strand—the velocity at which a single strand of fiberglass is being processed in the manufacture of a warp beam.

Manufacturing a tape with the strands—the process of fabricating a tape by combining a strip of backing material, such as a polymer film, and fiberglass strands.

Net zero amount of twist—an amount of twist in a yarn or strand that averages to zero over an extended length of the yarn or strand.

Rotational surface speed of the package—the velocity at the surface of a forming package where the strand of fiberglass is pulled off of the package.

Single fiberglass strand—one yarn of fiberglass consisting essentially of a plurality of glass filaments bonded together with an applied chemical coating, where the filaments are continuous throughout the strand.

Tape—a narrow flexible strip of material which is reinforced with fiberglass strands, commonly known as filament tape or strapping tape.

Untwisted fiberglass strands—Continuous filament fiberglass that consists essentially of a plurality of individual filaments gathered into a single strand, or yarn, manufactured in a method where there is no cabling or twist imparted to the plurality of filaments, such that the untwisted fiberglass strands are simply laid or gathered together with a chemical bonding agent.

Warp beam—a beam that is loaded with yarn such that a large number of individual yarns are wrapped around the barrel of the beam in a continuous sheet, or web, so that each successive wrap of yarn around the barrel of the beam pulls one complete layer of yarns.

Warper—equipment used to rotate a beam in the production of a warp beam.

DESCRIPTION

Figure 1:
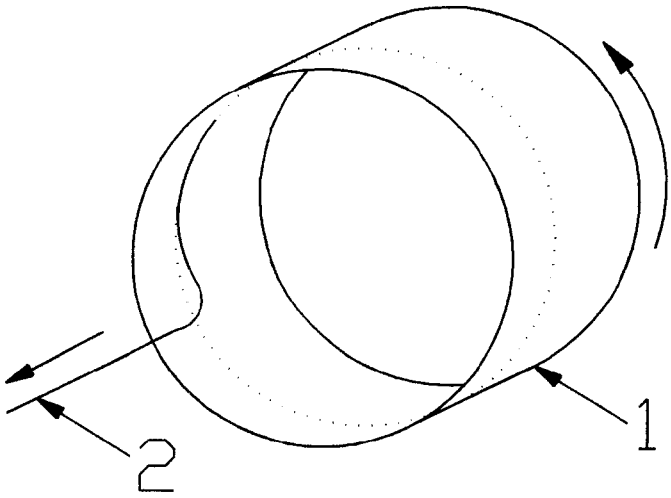
FIG. 1 is a pictorial representation of a rotating forming package with a strand being paid out from the inside.

The preferred embodiment of this process invention comprises: a process utilizing continuous filament fiberglass yarn shown in FIG. 1 whose form is a cylindrically wound package 1 where the yarn 2 is paid out from the inside of the package 1.

Figure 2:
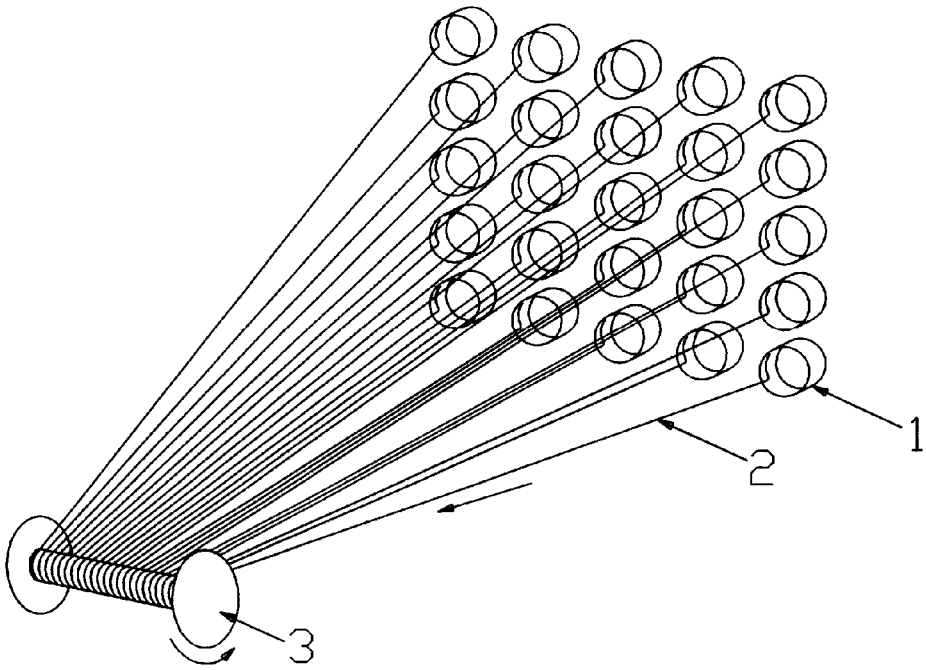
FIG. 2 is a pictorial representation of plurality of forming packages being paid out with their respective strands wrapped onto a beam.

Referring to FIG. 2, a plurality of packages 1 are processed in a textile warping operation, where the yarns 2 are combined onto a section beam or warp beam 3.

Figure 3:
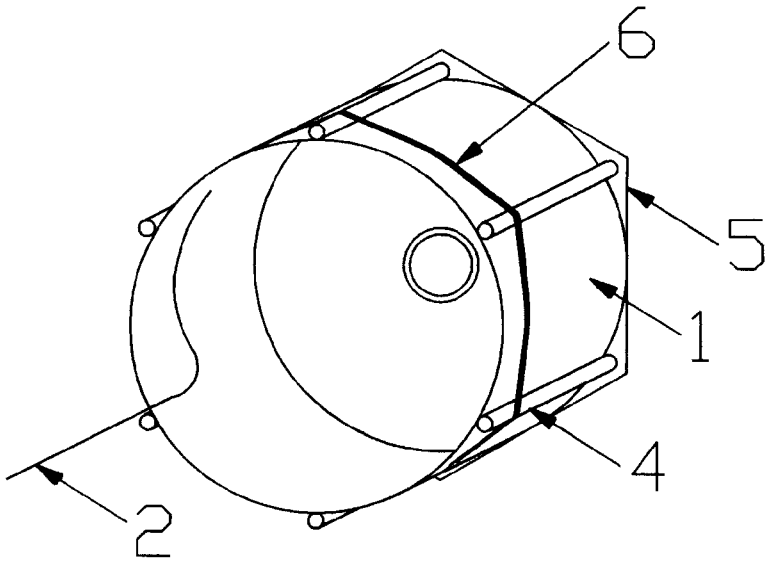
FIG. 3 is a pictorial representation of a forming package supported in a horizontal basket.

Referring to FIG. 3, the preferred manner for mounting the packages 1 is in a horizontal basket formed by a ring of rods 4 attached to a back plate 5 such that the package 1 sits inside the rods 4 and the yarn 2 is paid out from the inside of the package 1. Further, the rods 4 are slotted to accept a strap of flexible cord 6 wrapped around the outside of the rods 4 and yarn package 1 so that the rods 4 and strap or cord 6 compresses the package 1 to grip the outer layer of yarn.

Figure 4:
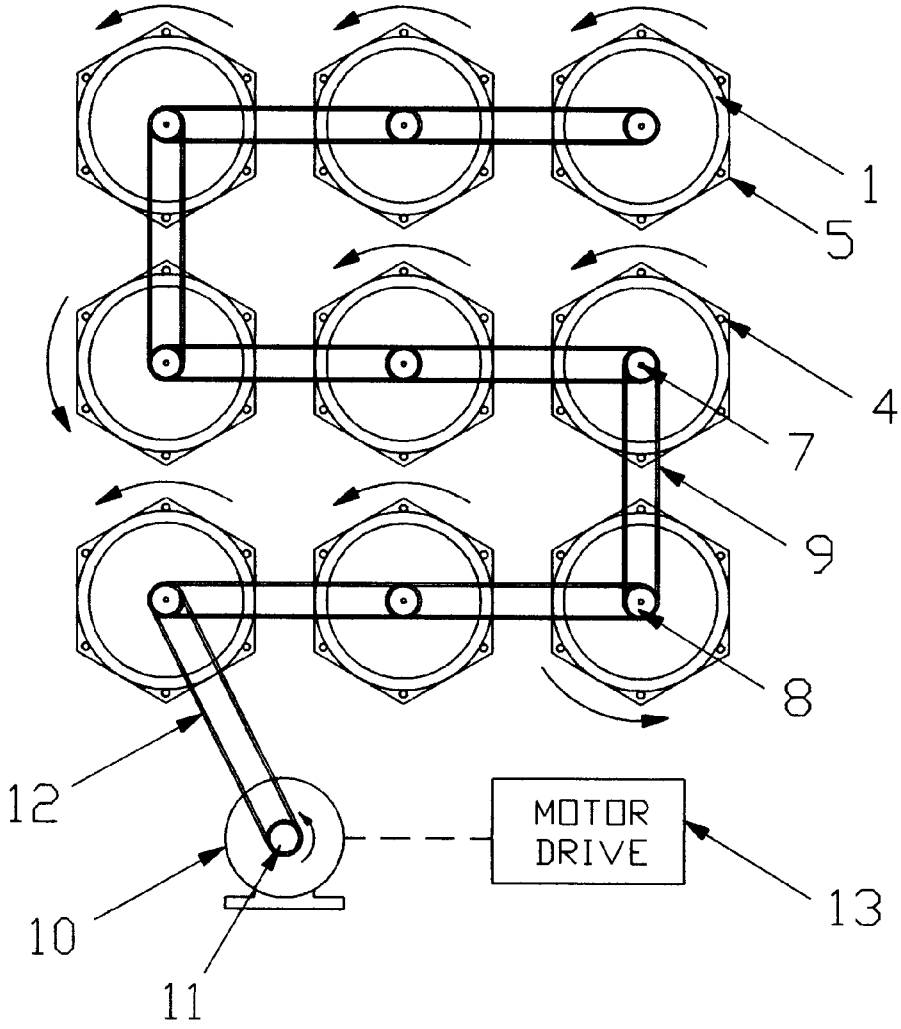
FIG. 4 is a pictorial representation of a plurality of forming packages supported in horizontal baskets with a motor drive, belts and pulleys.

Referring to FIG. 4, the preferred embodiment further consists of the back plate 5 mounted to a shaft 7 so that the rotation of the shaft will be transferred to the back plate 5, thus causing the back plate 5, rods 4, and yarn package 1 to rotate at the same speed as the shaft 7. Furthermore, the preferred embodiment has the shaft 7 mounted through two self-adjusting bearings (not shown), and attached to a drive pulley 8 in the rear of the shaft. The bearings are mounted on a framework (not shown) of a mobile truck (not shown) carrying the packages 1. The pulleys 8 on a single truck are ganged together by a series of drive belts 9 so that each package 1 rotates in the same direction. A single motor 10 of sufficient size to rotate the basket (identified above), including full packages 1, is mounted on the truck and a pulley 11 and belt 12 transfers the motor work to the baskets.

A motor drive 13 is mounted on the truck of packages so that each truck consists of one drive 13 and one motor 10. The motor drive 13 is linked to the drive system of the entire warper so that signals for line speed can be communicated to the motor drive 13. The motor drive 13 is then set or programmed to drive the packages 1 so that the rotational surface speed of the payout point on the package 1 equals the line speed of the warper. The packages are then driven so that no additional revolution of the yarn is imparted in the payout of the yarn (twist).

Various changes could be made in the above construction and method without departing from the scope of the invention as defined in the claims below. It is intended that all matter contained in the above description as shown in the accompanying drawings shall be interpreted as illustrative and not as a limitation.

We claim:

1. A process for making a warp beam of untwisted fiberglass strands comprising:

(a) providing a fiberglass forming package with a single fiberglass strand wound on the package and having a longitudinal axis;

(b) supporting the package in a manner that permits rotation of the package about the longitudinal axis;

(c) pulling the single strand from the package along the longitudinal axis and simultaneously rotating the package about the longitudinal axis while maintaining a rotational surface speed of the package equal to a linear speed of pulling the single strand and in a direction of rotation such that the fiberglass strand is pulled off the package with a net zero amount of twist; and (d) wrapping the single strand which is pulled from the package onto a beam which can be used to form a warp beam.

2. The process as recited in claim 1 including providing a plurality of fiberglass forming packages and wrapping the respective plurality of strands onto the beam.

3. The process as recited in claim 1 including weaving the strands from the beam with other strands of fiberglass having zero twist on a loom to form fiberglass cloth.

4. The process as recited in claim 2 including manufacturing a tape with the strands from the beam.

* * * * *